US011626242B2

(12) United States Patent
Gangel et al.

(10) Patent No.: US 11,626,242 B2
(45) Date of Patent: Apr. 11, 2023

(54) WINDING ASSEMBLY

(71) Applicant: Siemens Energy Global GmbH & Co. KG, Munich (DE)

(72) Inventors: Jürgen Gangel, Weiz (AT); Hans Jürgen Wagner, Gleisdorf (AT)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 407 days.

(21) Appl. No.: 16/955,445

(22) PCT Filed: Dec. 6, 2018

(86) PCT No.: PCT/EP2018/083865

§ 371 (c)(1),
(2) Date: Jun. 18, 2020

(87) PCT Pub. No.: WO2019/121048

PCT Pub. Date: Jun. 27, 2019

(65) Prior Publication Data

US 2020/0350112 A1 Nov. 5, 2020

(30) Foreign Application Priority Data

Dec. 20, 2017 (DE) ..... 10 2017 223 316.8

(51) Int. Cl.
*H01F 27/28* (2006.01)
*H01F 5/06* (2006.01)
(Continued)

(52) U.S. Cl.
CPC ..... *H01F 27/2828* (2013.01); *H01F 5/06* (2013.01); *H01F 27/02* (2013.01); *H01F 27/322* (2013.01); *H01F 27/363* (2020.08); *H01F 41/10* (2013.01)

(58) Field of Classification Search
CPC ..... H01F 27/2828; H01F 5/06; H01F 27/02; H01F 27/322; H01F 27/363; H01F 41/10; H01F 27/36; H01F 5/04
See application file for complete search history.

(56) References Cited

U.S. PATENT DOCUMENTS 2,728,879 A 12/1955 Erikson
2,787,769 A * 4/1957 Hill ..... H01F 41/10 29/605
(Continued)

FOREIGN PATENT DOCUMENTS

CN 1220040 6/1999
CN 1757082 4/2006
(Continued)

OTHER PUBLICATIONS

Office Action dated Jun. 24, 2021 issued in Chinese Patent Application No. 201880082539.2.
(Continued)

*Primary Examiner* — Tuyen T Nguyen
(74) *Attorney, Agent, or Firm* — Cozen O'Connor

(57) ABSTRACT

A winding assembly for a transformer, in particular with a medium operating voltage of Um≥79.5 kV, wherein the winding assembly includes at least one winding, which ends in a winding conductor, where the winding conductor is connected to a switching line, which is configured to interconnect the winding to other windings, and where the connection of the switching line to the winding conductor is arranged inside the winding so as to reduce the danger of partial discharges and flashovers in the high-voltage end-line region for high-temperature applications.

10 Claims, 1 Drawing Sheet

(51) Int. Cl.

| | |
|---|---|
| ***H01F 27/02*** | (2006.01) |
| ***H01F 27/32*** | (2006.01) |
| ***H01F 41/10*** | (2006.01) |
| ***H01F 27/36*** | (2006.01) |

(56) References Cited

U.S. PATENT DOCUMENTS

| | | | | |
|---|---|---|---|---|
| 4,091,349 | A | 5/1978 | Niederjohn et al. | |
| 8,466,767 | B2 * | 6/2013 | Piascik | H01F 5/04 336/192 |
| 8,754,735 | B2 * | 6/2014 | Piascik | H01F 27/327 336/192 |
| 2003/0094304 | A1 | 5/2003 | Leijon et al. | |
| 2013/0014986 | A1 * | 1/2013 | Ko | H01B 17/42 29/854 |
| 2013/0285776 | A1 | 10/2013 | Piascik et al. | |
| 2015/0206648 | A1 | 7/2015 | Man | |
| 2015/0213929 | A1 | 7/2015 | Piascik et al. | |

FOREIGN PATENT DOCUMENTS

| | | |
|---|---|---|
| CN | 104185891 | 12/2014 |
| CN | 106068541 | 11/2016 |
| CN | 206148718 U | 5/2017 |
| DE | 663163 | 7/1938 |
| DE | 202014006814 | 11/2014 |
| DE | 202014105168 | 11/2014 |
| EP | 2549494 | 1/2013 |
| EP | 2660832 | 11/2013 |
| GB | 376387 | 7/1932 |
| GB | 800992 | 9/1958 |
| JP | 2008288512 | 11/2008 |
| WO | 2012028222 | 3/2012 |

OTHER PUBLICATIONS

PCT International Search Report dated May 6, 2019 based on PCT/EP2018/083865 filed Dec. 6, 2018.

Examination Report dated Aug. 8, 2018 based on DE102017223316.8 filed Dec. 20, 2017.

* cited by examiner

WINDING ASSEMBLY

CROSS-REFERENCE TO RELATED APPLICATIONS

This is a U.S. national stage of application No. PCT/EP2018/083865 filed 6 Dec. 2018. Priority is claimed on German application No. 10 2017 223 316.8 filed 20 Dec. 2017, the content of which is incorporated herein in its entirety.

BACKGROUND OF THE INVENTION

1. Field of the Invention

The invention relates to a winding assembly for a transformer, in particular with a medium operating voltage of Um≥72.5 kV, where the winding assembly has at least one winding that ends or terminates in a winding conductor, and where the winding conductor is connected to a switching line, which is configured to interconnect the winding to other windings such that the inventive winding assembly can be used in various types of transformers, in particular in distribution transformers, such as in liquid-filled distribution transformers.

2. Description of the Related Art

An aramid insulation is often required for the end leads in the case of oil-filled distribution transformers for high temperature requirements, such as at an operating temperature of more than 105° C. With a medium operating voltage of Um≥72.5 kV, a high field strength occurs in the high-side voltage end lead range, i.e., in the high-voltage range. This selective field strength greatly increases the risk of partial discharges and flashovers. To reduce this electrical load, a shielding for conductor enlargement is used around the end lead in low-temperature applications. For high-temperature applications, some of these tried and tested materials used for many years are not available for shielding.

SUMMARY OF THE INVENTION

In view of the foregoing, it is therefore an object of the invention to provide a winding assembly that overcomes the disadvantages of the prior art and also reduces the risk of partial discharges and arcing in the high-side voltage end lead range for high-temperature applications.

This and other objects and advantages are achieved in accordance with the invention in which, starting from a winding assembly for a transformer, in particular with a medium operating voltage of Um≥72.5 kV, the winding assembly has at least one winding that ends in a winding conductor, where the winding conductor is connected to a switching line that is designed to connect the winding to other windings, and where the connection of the switching line to the winding conductor is arranged inside the winding.

By connecting the winding conductor to the switching line, which usually has a larger conductor cross-section than the winding conductor, inside the winding and forming the end lead with the switching line, the electrical field strength at the end lead is significantly reduced.

The fact that the connection of the switching line to the winding conductor is arranged inside the winding means that the connection is surrounded by the winding, viewed both in the radial direction of the winding and in the axial direction of the winding. If it is assumed that the winding is arranged around a winding axis then, for example, relative to the winding axis, there is still part of the winding both radially outside the inventive connection and also part of the winding axially before and after the connection. The winding conductors of the winding thus insulate the connection to a large extent, in particular completely, from the space outside the winding.

The invention is advantageously used for the high-side voltage winding (i.e., the high-voltage winding) of a transformer.

In order to easily and permanently electrically connect the winding conductor to the switching line, the connection between the switching line and the winding conductor is formed as a crimp connection. A crimp connection is created when two components are connected to one another by plastic deformation, such as by flanging, squeezing, crimping or folding. A crimp connection is not in itself a detachable connection. A crimp connection is a positive fit.

In the case of a crimp connection, a connecting element is generally used, into which one or both conductors to be connected are inserted. The connecting element can be formed as a sleeve or cable lug, for example. In addition to the electrical connection, crimping also establishes a mechanical connection between the two conductors to be connected, here the winding conductor and the switching line. Crimping pliers or crimping presses are, for example, used as tools for crimping. The shape of the tool and the pressing force must each be adjusted such that a positive connection is created, but none of the conductors is thereby destroyed, in particular broken. As an alternative to crimping, the two conductors can also be soldered or welded.

The connection is inside the winding. As a result, it is advantageous for the connecting element, which creates the connection between the switching line and the winding conductor, to be surrounded by an electrical shielding. Consequently, the electrical field of the winding is shielded from the switching line in a simple manner.

In particular, it can be provided for the electrical shielding to also surround the part of the winding conductor adjoining the connecting element and the part of the switching line adjoining the connecting element. As a result, good shielding of the connecting element is in any case achieved.

At its simplest, the electrical shielding can comprise a conductive layer, which at least surrounds the connecting element. Conductive foils, braids or sheets are conceivable here. The conductive layer may, for example, contain copper.

The electrical shielding, the part of the winding conductor adjoining the connecting element and the part of the switching line adjoining the connecting element can be surrounded by a common insulation. As a result, no conductive connection or flashover from the rest of the winding onto the switching line can occur.

If it is assumed that the winding is arranged around a winding axis, there are basically three embodiment conceivable, where a connection of a switching line to a winding conductor, in particular the corresponding connecting element, is arranged relative to the winding.

In the first embodiment, part of the winding is still located both radially outside a connection of a switching line to a winding conductor and also axially before and after this connection of the switching line to the winding conductor. The connection, in particular in the form of the connecting element, is therefore surrounded on both sides by winding conductors in the axial direction. In the radial direction, at least outside the connection, in particular outside the connecting element, further winding conductors or further sections of the same winding conductor are present. Insulation of the winding can, for example, be located radially inside. This embodiment is thus suitable for the start of the winding which, viewed in the radial direction of the winding, lies on the inside.

In the second embodiment, part of the winding is still located both radially inside a connection of a switching line to a winding conductor and also axially before and after this connection of the switching line to the winding conductor. The connection, in particular in the form of the connecting element, is thus surrounded on both sides by winding conductors in the axial direction. In the radial direction, at least inside the connection, in particular inside the connecting element, further winding conductors or sections of the same winding conductor are present. Insulation of the winding can, for example, be located radially outside. This embodiment is thus suitable for the end of the winding which, viewed in the radial direction of the winding, lies on the outside.

In the third embodiment variant, part of the winding is still located radially inside, radially outside, axially before and axially after a connection of a switching line to a winding conductor. The connection, in particular in the form of the connecting element, is therefore surrounded on all sides by winding conductors. This embodiment is suitable for taps which, viewed radially, lie between the start and end of the winding.

It is also conceivable for multiple inventive connections to be provided per winding. Thus, two or all three of the disclosed embodiment can also be present on a winding. In particular, multiple connections of the third embodiment can be present.

It is also an object of the invention to provide a transformer, in particular a power transformer, preferably an oil-filled distribution transformer, having the winding assembly in accordance with the disclosed embodiments. Power transformers are transformers that are established for high performance, such as for use in electrical energy grids.

Power transformers are frequently formed in a three-phase manner as three-phase AC transformers. In this case, power transformers in the range from a few tens of kVA to a few MVA are used in local transformer stations that are used to supply the low-voltage grids, and are referred to as distribution transformers. They are often liquid-filled, in this case generally oil-filled.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

To further explain the invention, reference is made in the following part of the description to the figures, from which further advantageous details and possible areas of application of the invention can be seen. The figures are to be understood as examples and are intended to set out the nature of the invention, but in no way narrow it down or even reproduce it conclusively, in which.

DETAILED DESCRIPTION OF THE EXEMPLARY EMBODIMENTS

Figure 1:
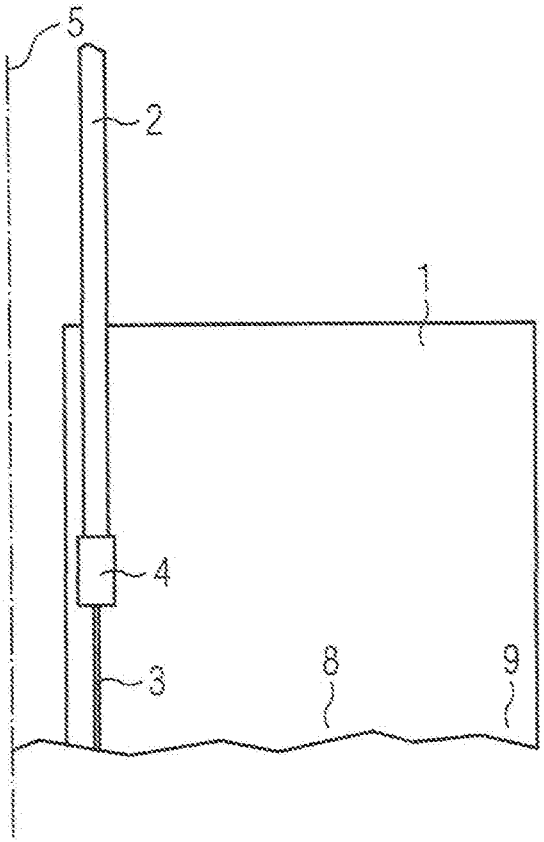
FIG. 1 is a longitudinal cross-sectional illustration of the winding assembly in the region of the connection between switching line and winding conductor in accordance with the invention.

FIG. 1 shows the upper end of an inventive winding assembly with a winding 1, which is arranged around a winding axis 5. Further windings can be arranged radially inside and/or outside the winding 1. The winding 1 is generally wound around a core leg (not shown), of a transformer core and consists of one or more winding conductors 3. The winding conductor 3 can, for example, be a winding wire. In order to conduct the electrical energy out of the winding 1 and then out of the transformer housing that surrounds the windings 1, or to introduce the electrical energy from outside through the transformer housing into the winding 1, an "end lead" is provided, in other words a conductive connection that connects the end of the winding conductor 3 of the winding 1 through the transformer housing to a line outside the transformer.

The end lead also comprises "switching lines" 2, via which the individual windings 1 of the transformer can still be interconnected inside the transformer housing. In this way, the three phases of a three-phase AC transformer can be interconnected.

The winding 1 ends in a winding conductor 3 and is connected via a connecting element 4 to a switching line 2 that is used to connect the winding 1 to other windings. The connecting element 4 is arranged inside the winding. On the one hand, this means that in the radial direction of the winding 1, i.e., at right angles to the winding axis 5, a part of the winding 1 is still located at least outside the connecting element 4, here the majority of the winding 1. The end of the winding conductor 3 here forms the start of the winding 1, which is formed here as a high-side voltage winding. The start of the winding and thus the connecting element 4 lies here—viewed in the radial direction—on the inside of the insulation of the winding 1 to the main scattering gap, and this in turn lies between the high-side voltage winding and the low-voltage winding.

Inside the winding also means that a part of the winding 1 is still located in the direction parallel to the winding axis 5 before and after the connecting element 4. In FIG. 1, there are thus also further winding conductors of the winding 1 above and below the connecting element 4. These further winding conductors of the winding 1 therefore insulate the connecting element 4 from the space outside the winding 1.

The arrangement of the connection, i.e., the connecting element 4 here, corresponds in FIG. 1 to the previously described first embodiment for the start of the winding. However, in accordance with the second embodiment, the connecting element 4 could also be used for the end of the winding which, viewed in the radial direction of the winding 1, lies on the outside, see the alternative position 9 of the connecting element 4, drawn in as a perpendicular line. The connecting element 4 would then be radially outside, for example, only surrounded by the insulation of the winding 1, on all other sides (radially inside, axially) by the winding conductors of the winding 1. However, in accordance with the third embodiment, the connecting element 4 could also be used for a tap which, viewed in the radial direction of the winding 1, lies at any point between the start and end of the winding, see the exemplary alternative position 8 of the connecting element 4, drawn in as a perpendicular line. The connecting element 4 would then be surrounded on all sides by winding conductors of the winding 1.

Because the switching line 2 has a larger conductor cross-section than the winding conductor 3, the electrical field strength on the outside of the switching line 2 outside the winding 2 is lower than in the case of the winding conductor 3, if this were to be led out of winding 1—in FIG. 1 above out of the winding 1—instead of the switching line 2.

Figure 2:
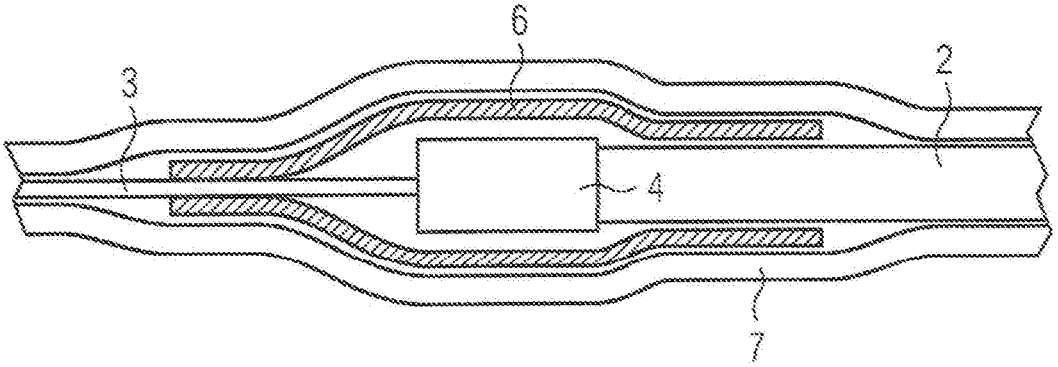
FIG. 2 is a longitudinal cross-sectional illustration of the region around the connection between the switching line and winding conductor of FIG. 1.

In FIG. 2 the connecting element and—partially in section—its immediate surroundings are shown enlarged. Both the switching line 2 and the winding conductor 3, which has a smaller cross-section than the switching line 2, are guided into the connecting element 4 and mechanically and electrically conductively connected to one another therein via a crimp connection. An electrical shielding 6 surrounds the connecting element 4, the part of the winding conductor 3 adjoining the connecting element 4 and the part of the switching line 2 adjoining the connecting element 4. In this region—seen in the direction parallel to the winding axis 5 (see FIG. 1)—and beyond an insulation 7 is provided that surrounds the electrical shielding 6, the part of the winding conductor 3 adjoining the connecting element 4 and the part of the switching line 2 adjoining the connecting element 4.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A winding assembly for a transformer having a medium operating voltage of Um≥72.5 kV, comprising:

a winding conductor;

at least one winding which ends in the winding conductor, the winding conductor being connected to a switching line which is configured to connect the winding to other windings; and a connecting element which establishes the connection between the switching line and the winding conductor, the connecting element being surrounded by an electrical shielding;

wherein the connection of the switching line to the winding conductor is arranged inside the winding;

wherein the electrical shielding also surrounds a part of the winding conductor adjoining the connecting element and a part of the switching line adjoining the connecting element; and wherein the electrical shielding, the part of the winding conductor adjoining the connecting element and the part of the switching line adjoining the connecting element are surrounded by a common insulation.

2. The winding assembly as claimed in claim 1, wherein the connection between the switching line and the winding conductor is a crimp connection.

3. The winding assembly as claimed in claim 1, wherein the electrical shielding comprises a conductive layer which at least surrounds the connecting element.

4. The winding assembly as claimed in claim 1, wherein part of the at least one winding is still located both radially outside a connection of the switching line to the winding conductor and also axially before and after this connection of the switching line to the winding conductor.

5. The winding assembly as claimed in claim 1, wherein part of the at least one winding is still located both radially inside a connection of the switching line to the winding conductor and also axially before and after this connection of the switching line to the winding conductor.

6. The winding assembly as claimed in claim 1, wherein part of the winding is still located radially inside, radially outside, axially before and axially after a connection of the switching line to the winding conductor.

7. A transformer having the winding assembly as claimed in claim 1.

8. The transformer as claimed in claim 7, wherein the transformer is a power transformer.

9. The transformer as claimed in claim 8, wherein the power transformer is an oil-filled distribution transformer.

10. A winding assembly for a transformer having a medium operating voltage of Um≥72.5 kV, comprising:

a winding conductor;

at least one winding which ends in the winding conductor, the winding conductor being connected to a switching line which is configured to connect the winding to other windings; and a connecting element which establishes the connection between the switching line and the winding conductor, the connecting element being surrounded by an electrical shielding;

wherein the connection of the switching line to the winding conductor is arranged inside the winding;

wherein the electrical shielding comprises a conductive layer which at least surrounds the connecting element; and wherein the electrical shielding, the part of the winding conductor adjoining the connecting element and the part of the switching line adjoining the connecting element are surrounded by a common insulation.

* * * * *